US010563957B1

(12) United States Patent
Hamilton

(10) Patent No.: US 10,563,957 B1
(45) Date of Patent: Feb. 18, 2020

(54) IN-LINE FLASHLIGHT SYSTEM FOR FIREARMS

(71) Applicant: Steven R. Hamilton, Gillette, WY (US)

(72) Inventor: Steven R. Hamilton, Gillette, WY (US)

( * ) Notice: Subject to any disclaimer, the term of this patent is extended or adjusted under 35 U.S.C. 154(b) by 0 days.

(21) Appl. No.: 16/365,456

(22) Filed: Mar. 26, 2019

(51) Int. Cl.

| | |
|---|---|
| ***F41G 1/00*** | (2006.01) |
| ***F41G 11/00*** | (2006.01) |
| ***F41G 1/35*** | (2006.01) |
| ***F21V 19/04*** | (2006.01) |
| ***F21L 4/00*** | (2006.01) |

(52) U.S. Cl.
CPC ..... *F41G 11/004* (2013.01); *F21L 4/005* (2013.01); *F21V 19/04* (2013.01); *F41G 1/35* (2013.01)

(58) Field of Classification Search
CPC ..... F41G 1/35
See application file for complete search history.

(56) References Cited

U.S. PATENT DOCUMENTS 1,456,440 A * 5/1923 Hise ..... F41G 1/35 362/191
1,610,092 A * 12/1926 Hise ..... F41G 1/35 362/110
2,486,998 A * 11/1949 Szeklinski ..... F21L 4/00 340/321
2,597,565 A * 5/1952 Chandler ..... F41C 23/16 362/110
3,222,511 A 12/1965 Breeding
3,281,586 A * 10/1966 Gonzalez ..... A45B 3/04 362/102
3,445,951 A 5/1969 Bechard et al.
3,488,488 A 1/1970 Crouch
3,513,581 A 5/1970 Slater
4,627,183 A 12/1986 Stuckman
4,856,218 A 8/1989 Reynolds, Jr.
5,050,053 A * 9/1991 McDermott ..... F21L 4/005 200/60
5,060,123 A * 10/1991 Arnold ..... F21V 33/0064 362/102
5,117,341 A * 5/1992 Huang ..... F21L 2/00 362/184
5,297,533 A * 3/1994 Cook ..... F41B 5/14 124/23.1
5,440,465 A * 8/1995 Hasness ..... A45F 5/02 362/103
5,628,555 A * 5/1997 Sharrah ..... F41G 1/34 362/114
5,727,346 A 3/1998 Lazzarini et al.
6,023,875 A 2/2000 Fell et al.
6,565,226 B1 5/2003 Cummings
(Continued)

*Primary Examiner* — Gabriel J. Klein
(74) *Attorney, Agent, or Firm* — James R. Young; Cochran Freund & Young LLC

(57) ABSTRACT

A flashlight mounting system for mounting a flashlight on a firearm includes a light barrel, which is sized and shaped for containing a flashlight and which is mountable on the firearm, a light activator plug positioned inside the light barrel, a light control member positioned on the outside of the light barrel, and a connector, which extends through a slotted hole in the light barrel and connects the light control member to the light activator plug. Sliding the light control member on the outside of the light barrel moves the light activator plug on the inside of the light barrel to push and activate an on-off switch on the flashlight in the light barrel.

9 Claims, 5 Drawing Sheets

(56) References Cited

U.S. PATENT DOCUMENTS

| | | | | |
|---|---|---|---|---|
| 6,722,076 | B2 | 4/2004 | Nielsen | |
| 7,117,627 | B2 | 10/2006 | Woodmansee, III et al. | |
| 7,736,013 | B2 * | 6/2010 | Griffin | F21V 21/08 362/110 |
| 8,550,654 | B2 | 10/2013 | Olsen | |
| 8,584,392 | B1 | 11/2013 | Young | |
| 9,080,834 | B1 | 7/2015 | Williford | |
| 9,080,835 | B1 | 7/2015 | Williford | |
| 9,080,836 | B1 | 7/2015 | Williford | |
| 9,175,924 | B1 | 11/2015 | Williford | |
| 9,228,804 | B2 | 1/2016 | Syrengelas et al. | |
| 9,658,029 | B1 * | 5/2017 | Williford | F41C 27/00 |
| 2003/0090894 | A1 * | 5/2003 | Cummings | F41C 27/00 362/110 |
| 2004/0045209 | A1 * | 3/2004 | Nielsen | F41G 1/35 42/146 |
| 2007/0039225 | A1 * | 2/2007 | Kallio | F41G 1/35 42/146 |
| 2007/0137087 | A1 | 6/2007 | Florea et al. | |
| 2007/0277422 | A1 | 12/2007 | Ding | |
| 2008/0040965 | A1 | 2/2008 | Solinsky et al. | |
| 2010/0277896 | A1 | 11/2010 | Oehlkers | |
| 2011/0099876 | A1 | 5/2011 | Bentley | |
| 2013/0050993 | A1 * | 2/2013 | Campman | F21L 4/005 362/102 |
| 2014/0063791 | A1 * | 3/2014 | Frazier | F21L 4/00 362/110 |

* cited by examiner

IN-LINE FLASHLIGHT SYSTEM FOR FIREARMS

BACKGROUND

Technical Field of the Invention

The present invention is related to accessories for firearms and more particularly to flashlights mounted on firearms.

State of the Prior Art

Flashlights are common accessories for use with firearms in tactical and self-defense situations to illuminate dark places in order to see and identify threats or to temporarily blind or disorient an attacker. Some people prefer to have a flashlight mounted on a firearm instead of holding the flashlight with one hand, thus freeing both hands to handle the firearm, at least for some situations or for use with larger weapons, such as shotguns. There are a variety of flashlight mounting hardware and systems available for mounting flashlights on firearms with various advantages, disadvantages, and limitations. For example, some flashlight mounting systems clamp the flashlight to the barrel of the firearm, but such systems are subject to coming loose through prolonged use of the firearm due to forces of recoil and barrel harmonics. Also, such barrel mount systems have inconvenient ergonomics for reaching and activating on-off buttons or switches, and pressure pad-type on-off switches are prone to wear, damage, and deterioration over time. Another category of lighting systems involves building a flashlight or other light assembly into the forearm of the firearm, which can be more durable than barrel mount flashlight systems and can have better ergonomics for accessing and operating the light activation switches, but the light extends out of the typical volumetric profile of normal forearms, thus slightly more bulky, and such systems are more expensive. Still another category of flashlight or other light mounting systems include a variety of mounting hardware configurations that attach to the distal (front) end of the firearm magazine tube in place of the normal magazine cap.

The foregoing examples of the related art and limitations related therewith are intended to be illustrative and not exclusive. Other limitations of the related art and other examples of related art will become apparent to those of skill in the art upon a reading of the specification and a study of the drawings.

SUMMARY

The following embodiments and aspects thereof are described and illustrated in conjunction with systems, tools, and methods which are meant to be examples and illustrative, not limiting in scope. In various embodiments and implementations, one or more problems have been reduced or eliminated, while other embodiments are directed to other improvements and benefits.

In one aspect, a flashlight mounting system for mounting a conventional flashlight to a distal end of a component of a firearm comprises an elongate, cylindrical light barrel, a light activator plug positioned in a longitudinally slidable manner inside the light barrel, a light control member positioned in a longitudinally slidable manner on an outside surface of the light barrel, and a connector extending from the light control member through a slotted hole in the light barrel and into the light activator plug to connect the light control member to the light activator plug, wherein the slotted hole has a first longitudinally slotted portion that is long enough to accommodate longitudinal movement of the connector far enough to accommodate longitudinal movement of the light activator plug inside of the light barrel far enough toward the distal end of the light barrel to actuate a push-button on-off switch on the back end of the flashlight positioned inside the light barrel.

Another aspect of the invention is that the component of the firearm can be a magazine tube, and the proximal end of the light barrel of the flashlight mounting system is adapted for mounting on the distal end of the magazine tube.

In one embodiment, the light control member is a ring positioned around the outside surface of the light barrel.

In another embodiment, the connector includes a bolt that extends through the light control member and through the slotted hole in the light barrel and into the light activator plug so that the light control member, the connector, and the light activator plug are movable in unison with each other.

In another embodiment, a retention sleeve is mounted in a removable manner on the distal end of the light barrel, said retention sleeve having a radially inwardly extending lip around an aperture of a size that accommodates propagation of light produced by the flashlight in the light barrel while the lip prevents longitudinal movement of the flashlight through the distal end of the light barrel.

In another embodiment, the slotted hole also includes a second longitudinally extending portion extending from the transversely slotted portion of the slotted hole, whereby longitudinal movement of the connector into the second longitudinally slotted portion of the slotted hole prevents rotational movement of the light control member and rotational movement of the light activator plug.

In another aspect of the invention, a method of mounting a flashlight on a firearm comprises inserting the flashlight in an elongate, cylindrical light barrel that has a slotted hole with a longitudinally extending first slotted portion, a light activator plug positioned in a longitudinally slidable manner in the light barrel proximal to a push-button on-off switch on the rear end of the flashlight, and a light control member positioned in a longitudinally slidable manner on an outside surface of the light barrel, and a connector extending from the light control member through the slotted hole in the light barrel and into the light activator plug, and attaching the light barrel on a component of the firearm either before or after inserting the flashlight in the light barrel.

In one embodiment of the invention, the method includes mounting the light barrel on a distal end of a magazine component of the firearm.

In addition to the example aspects, embodiments, and implementations described above, further aspects, embodiments, and implementations will become apparent to persons skilled in the art after becoming familiar with the drawings and study of the following descriptions.

BRIEF DESCRIPTION OF THE DRAWINGS

The accompanying drawings, which are incorporated herein and form a part of the specification, illustrate some, but not the only or exclusive, example embodiments and/or features. It is intended that the embodiments and figures disclosed herein are to be considered illustrative rather than limiting. In the drawings.

DETAILED DESCRIPTIONS OF EXAMPLE EMBODIMENTS

Figure 1:
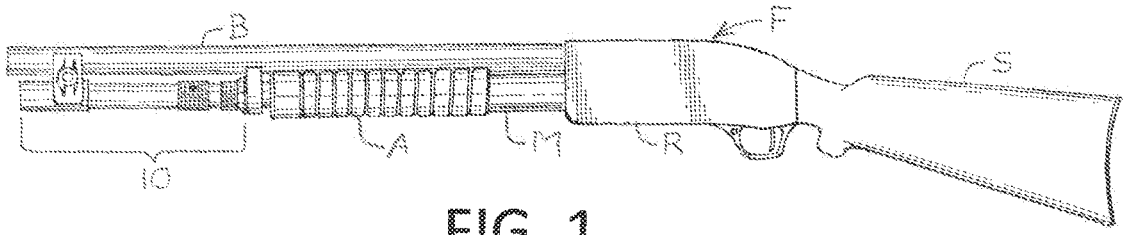
FIG. 1 is a side elevation view of an example firearm equipped with an example flashlight mounting system.
Figure 2:
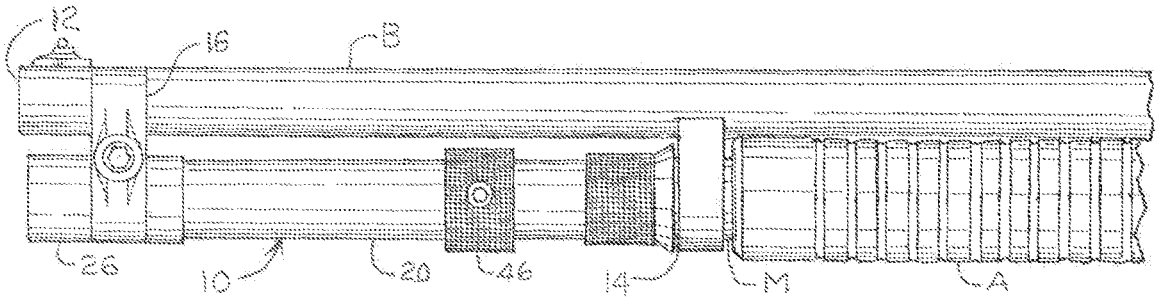
FIG. 2 is an enlarged side elevation view of the example flashlight mounting system in FIG. 1 mounted on the distal (front) end of the magazine tube of the example firearm.
Figure 3:
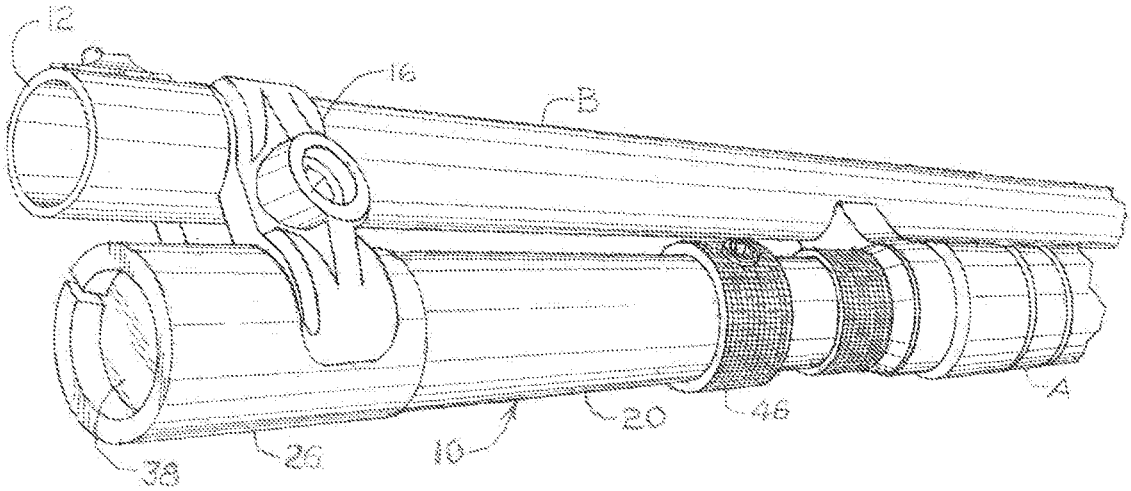
FIG. 3 is an enlarged perspective view of the example flashlight mounting system in FIG. 1 mounted on the distal (front) end of the magazine tube of the example firearm.

An example flashlight mounting system 10 is illustrated in FIGS. 1-3 mounted on the distal (front) end of a component of a firearm F, which in FIGS. 1-3 is the distal (front) end of the magazine tube M of an example firearm F. A conventional flashlight with a push-button on-off switch (not visible in FIGS. 1-3) is contained in the flashlight mounting system 10, so that attaching the flashlight mounting system 10 to the distal (front) end 14 of the magazine tube M, as will be explained in more detail below, effectively mounts the flashlight near the distal end of the firearm F under the firearm barrel B and just forward of the forearm (sometimes called fore-stock) A of the firearm F. That mounting position results in the flashlight always being pointed to shine light in the same direction as the firearm barrel B and with nothing to interfere with the propagation of light in that direction, while also being near and easily reachable by the user's hand that normally grasps and holds the forearm A of the firearm F. For clarity, the flashlight mounting system 10, various components of the flashlight mounting system 10, various components of the firearm F, and directional relationships will be described in reference to the distal ends and proximal ends of such system and components. In these descriptions, proximal corresponds to the rear (stock) end of the firearm, which, in use is positioned adjacent to or in contact with the person using the firearm, and distal corresponds to the front (muzzle) end of the firearm, which, in use is positioned away from the person using the firearm. Accordingly, forward means a direction toward the front end of the firearm, and rearward means a direction toward the rear end of the firearm, unless otherwise indicated.

The firearm F in FIGS. 1-3 is illustrated for example as a pump shotgun, but the example flashlight mounting system 10 can be used with other types of shotguns as well as with a variety rifles and other kinds of firearms. For illustrating the example flashlight mounting system 10, its mounting, and its operation, it is shown and described for convenience as being mounted on a pump shotgun. Typical pump shotguns as illustrated in FIG. 3 have a receiver R mounted on a stock S, a barrel B extending from the Receiver R to a distal end 12 of the barrel B, a magazine tube M extending from the receiver R under the barrel B to a distal end 14 of the magazine tube M, and a forearm (sometimes called a fore-stock) A mounted in a slidable manner on the magazine tube M and connected to an action mechanism (not shown). As is also typical of many shotguns, the distal end of the magazine tube M is threaded (not visible in the Figures), and a magazine cap (not shown) screws onto the distal end of the magazine tube M. Several examples of such-shotguns include Remington model 870 pump action shotgun, Remington model 1100 semiautomatic shotgun, Mossberg models 5500 and 9200 pump action shotguns, Benelli Nova, SBE, SBE II, Mi, and M2 shotguns, and Beretta Extrema shotgun, but there may be others as well. For such typical shotguns, the example flashlight mounting system 10 replaces the normal magazine cap (not shown), whereby the flashlight mounting system 10 is screwed onto the distal end 14 of the magazine tube M as described in more detail below. A clamp 16 is provided to clamp the flashlight mounting system 10 to the shotgun barrel B for additional stability and robustness.

Figure 4:
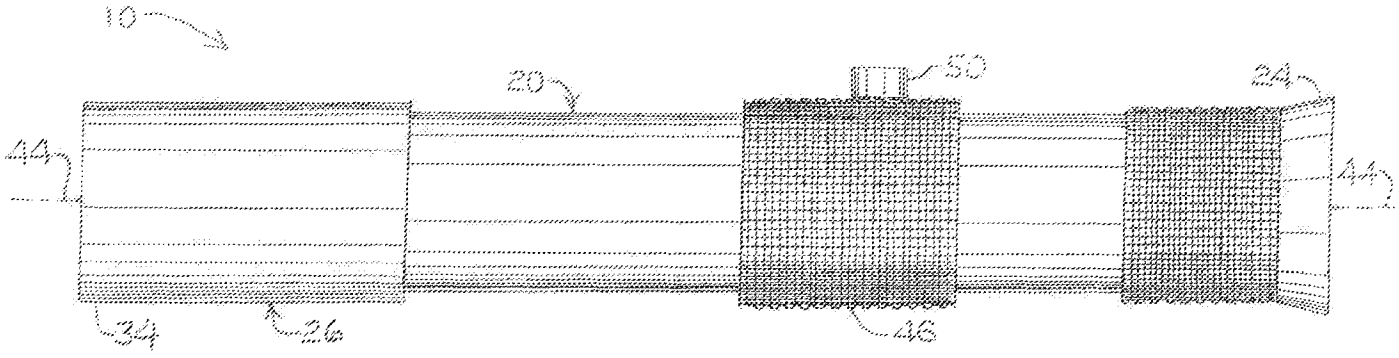
FIG. 4 is a side elevation view of the example flashlight mounting system in FIG. 1.
Figure 5:
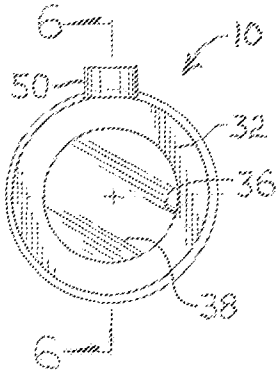
FIG. 5 is a front elevation view of the example flashlight mounting system in FIG. 1.
Figure 6:
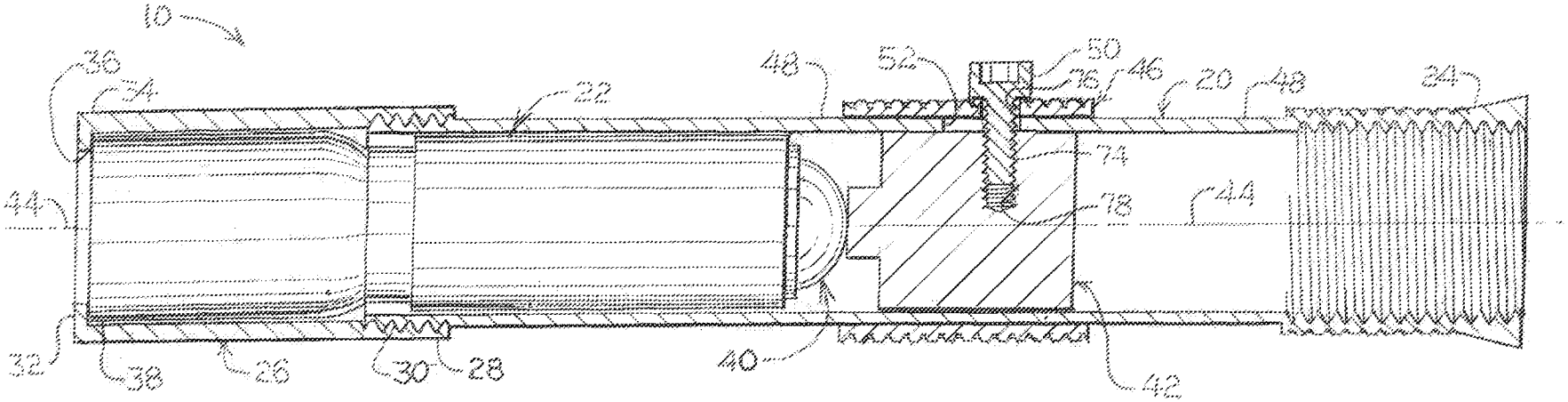
FIG. 6 is an enlarged cross-section view of the example flashlight mounting system taken along section plane 6-6 in FIG. 5 illustrating an example conventional flashlight in the example flashlight mounting system.

Referring now primarily to FIGS. 4-6 with secondary reference to FIGS. 1-3, the example flashlight mounting system 10 comprises an elongate, cylindrical light barrel 20, which is sized and shaped in a manner that accommodates and holds a flashlight 22 inside the light barrel 20. The light barrel 20 has an internally threaded proximal end 24 that is sized to screw onto external threads (not shown) on the distal end 14 of the firearm magazine tube M. A retention sleeve 26 with internal threads in its proximal end 28 screws onto external threads on the distal end 30 of the light barrel 20 to retain the flashlight 22 in the light barrel 20. A circular lip 32 on the distal end 34 of the retention sleeve extends radially inwardly enough to bear on the distal end 38 of the flashlight 22, which prevents the flashlight 22 from moving longitudinally forward in the light barrel 20 any farther than the lip 22. The lip 22 bounds an aperture 36 that permits light emitted from the distal (front) end 38 of the flashlight 22 to propagate in the forward direction, i.e., the direction in which the firearm barrel B is pointed.

The flashlight 22 can be any conventional flashlight that is turned on and off by pushing a push-button on-off switch 40 or similar push-button on-off actuator on the back end of the flashlight 22. Such flashlights with such push-button on-off switches or activators on the back ends of the flashlights, usually with light-emitting diode (LED) light sources, are common place and widely available commercially, for example, a LED LENSER model 880012 manufactured by the LEDLENSER division of Leatherman Tool Group, Inc., Portland, Oreg., and are well-known to persons skilled in the art of tactical firearm training and use. Therefore, it is not necessary to describe such flashlights further. Suffice it to say that the push-button on-off switch or activators on the back ends of such flashlights typically have a spring bias that yieldably resists an external longitudinal axial force that depresses the push-button and that restores the push-button to its normal, non-depressed condition when the external force is removed. Also, it is usual for such flashlight that pushing and releasing the push-button on-off switch turns the flashlight on, and pushing and releasing the push-button on-off switch again turns the flashlight off. Such a push-button on-off switch 40 is shown in FIG. 6 on the back end of the flashlight 22.

Figure 7:
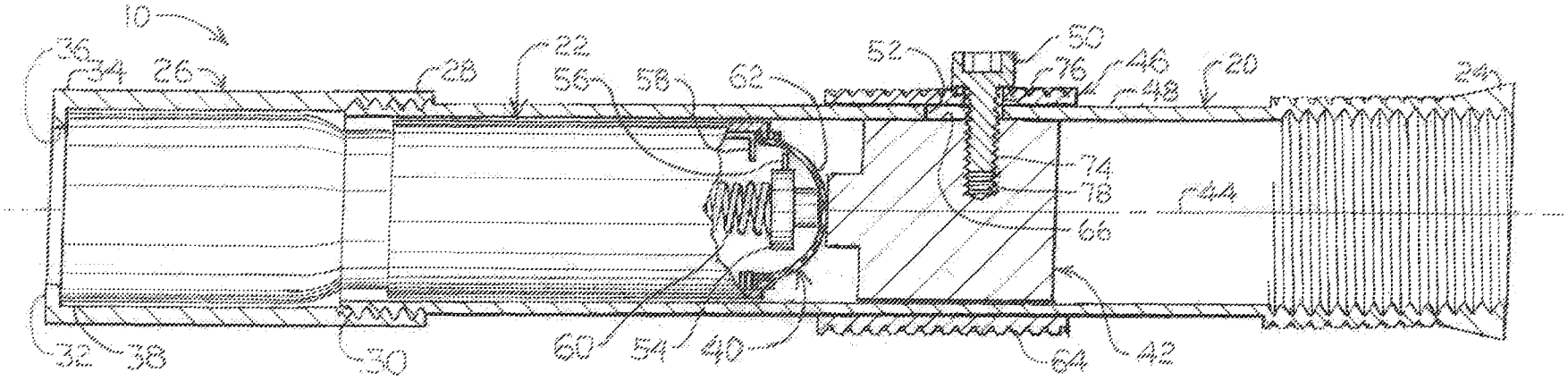
FIG. 7 is an enlarged cross-section view similar to FIG. 6, but with proximal (rear) portion of the flashlight cut away to reveal an example push-button on-off switch of the flashlight on non-actuating position.
Figure 8:
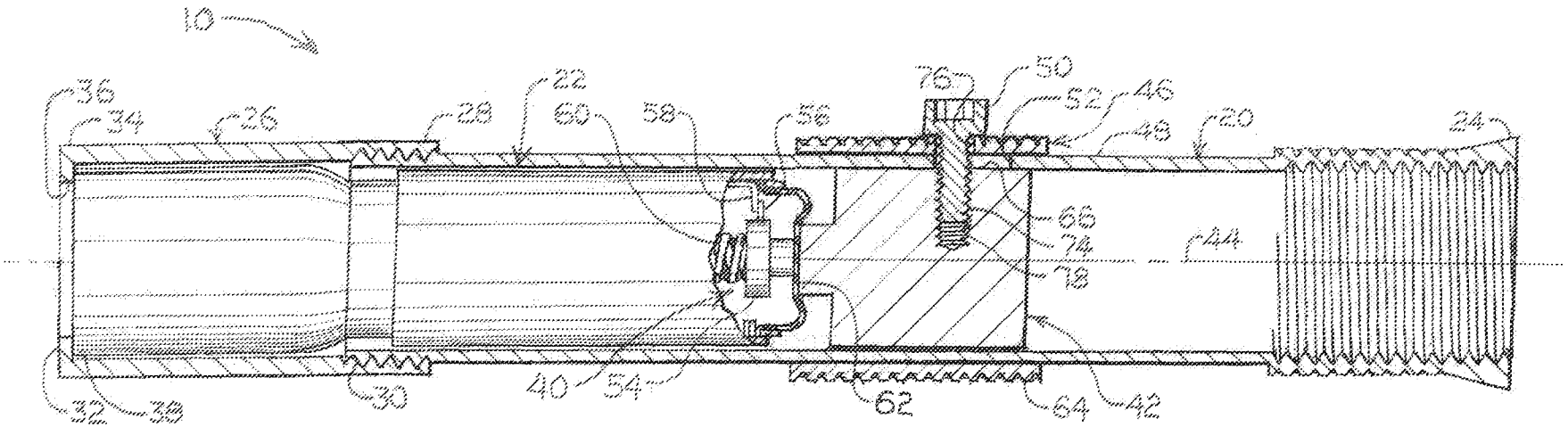
FIG. 8 is an enlarged cross-section view similar to FIGS. 6 and 7 with the proximal (rear) portion of the flashlight cut away, but with the example push-button on-off switch of the flashlight in actuating position.

In the example flashlight mounting assembly 10, a light activator plug 42 is positioned in a longitudinally slidable manner inside the light barrel 20 rearward from the flashlight 22 so that forward movement of the light activator plug 42 along the longitudinal axis 44 of the light barrel 20 can push the push-button on-off switch 40 of the flashlight 22 as illustrated in FIGS. 7 and 8. A light control member 46 positioned in a slidable manner on the external surface 48 of the light barrel 20 is connected by a connector 50 to the light activator plug 42 through a slotted hole 52 in the light barrel 20. The light control member 46 can have any convenient configuration that can be grasped conveniently by the user. In the example flashlight mounting system 10, the light control member 46 is illustrated as a cylindrical sleeve 46 surrounding the light barrel 20 and that is slidable forward and backward on the external surface 48 of the light barrel 20. However, the light control member 46 could be a knob, button, or any other convenient configuration instead of a sleeve. Accordingly, when a user pushes the light control sleeve 46 forward in the direction of the longitudinal axis 44 of the light barrel 20, it moves the light activator plug 42 forward along the longitudinal axis 44 and into the push-button on-off switch 40 of the flashlight 22, and, as illustrated in FIGS. 7 and 8, pushing the light control sleeve 46 far enough forward causes the light activator plug 42 to push the push-button on-off switch 40 of the flashlight 22. As explained above, pushing the push-button on-off switch 40 causes the flashlight 22 to be turned on or turned off.

Myriad different flashlights that have push-button on-off switches on the back ends of such flashlights are available from myriad manufacturers, and the push-button on-off switches in such different flashlights may have different structural details and components. The example push-button on-off switch 40 in FIGS. 7 and 8 is merely a diagrammatic representation generally of a push-button on-off switch in a flashlight, not any particular push-button on-off switch, and is shown only for purposes of illustrating the structures and interfacing functionalities of the light control sleeve 46, connector 50, and light activator plug 42 to push and release a push-button on-off switch on the proximal end of a flashlight positioned in the light barrel 20, not for the structure or functionality of any particular flashlight on-off switch. With that understanding in mind, the conceptual example push-button on-off switch 40 in FIGS. 6-8 is illustrated by an axially movable switch component 54 with a movable electric contact 56, a stationary electric contact 58, a resilient force biasing component 60, and a resiliently deformable cover 62. In the example push-button on-off switch 40, the resilient force biasing component 60 is illustrated as a coiled spring, but other springs, spring washers, spring discs, and the like could also be used. In the normal, non-actuating position shown in FIGS. 6 and 7, the resilient force biasing component 60 forces the movable switch component 54 with the movable electric contact 56 away from the stationary electric contact 58 and toward the back end of the flashlight 22, thereby pushing the resiliently deformable cover 62 to its normal outstretched configuration. For actuating the push-button on-off switch 40 to turn the flashlight either on or off, the user can push the light control sleeve 46 forward (i.e., in the direction of the longitudinal axis 44 toward the distal end 34 of the flashlight mounting system 10), which simultaneously moves the light activator plug 42 in the same forward direction to push against the push-button on-off switch 40 as shown in FIG. 8 while the lip 32 at the distal end 34 of the flashlight mounting system 10 prevents the flashlight 22 from moving forward. When the user applies enough force in that direction on the light control sleeve 46 to overcome the bias force of the resilient force biasing component 60 on the axially movable switch component 54, the resiliently deformable cover 62 collapses as shown in FIG. 8 as the axially movable switch component 54 and movable electric contact 56 are moved axially along the longitudinal axis 44 until the movable electric contact 56 contacts the stationary electric contact 58 to close an electric circuit (not shown) in the flashlight 22, which turns on or off the flashlight. Then, when the user releases the light control sleeve 46, the resilient force biasing component 60 pushes the movable switch component 54 and movable electric contact 56 axially away from the stationary electric contact 58 to open the electric circuit (not shown) in the flashlight 22 and back to the extended position of the resiliently deformable cover 62 as shown in FIGS. 6 and 7. On one such contact between the movable electric contact 56 and the stationary electric contact 58, the electric circuit (not shown) in the flashlight 22 turns on the flashlight 22 to produce light, and the flashlight remains on when the movable electric contact 56 moves away from the stationary electric contact 58. Then, on the next contact between the movable electric contact 56 and the stationary electric contact 58, the electric circuit (not shown) in the flashlight 22 turns off the flashlight 22, which ends the production of light by the flashlight 22. According, the user can turn the flashlight on by pushing the light control sleeve 46 forward and then releasing it, and then the user can turn the flashlight off by again pushing the light control sleeve 46 forward again and releasing it again. The outside surface 64 of the light control sleeve 64 can be knurled as shown in FIGS. 1-8 to facilitate sure and easy grip by the user's fingers on the light control sleeve 64, which enhances reliable and easy operation of the example flashlight mounting system 10 for turning the flashlight on and off.

Figure 9:
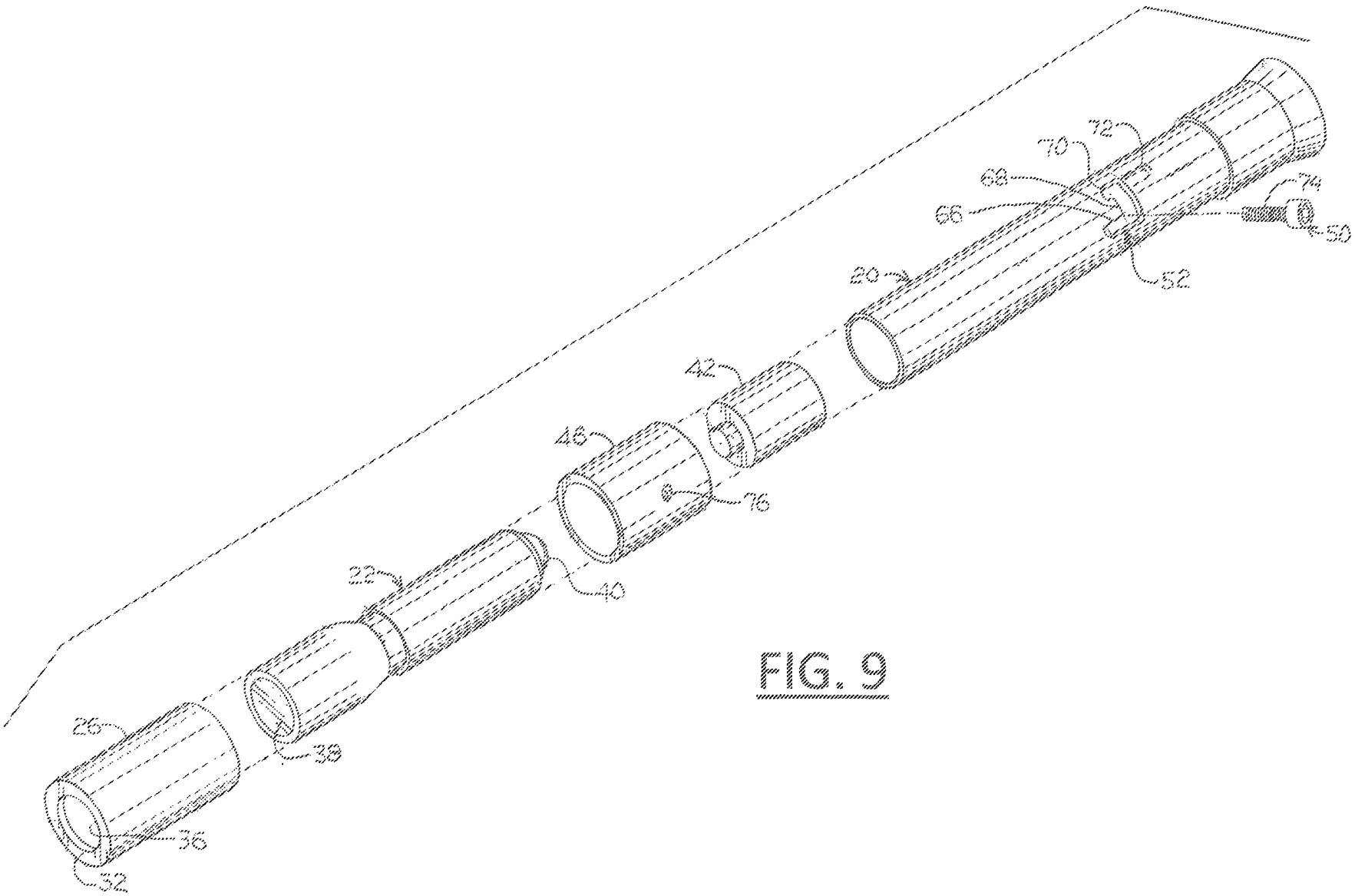
FIG. 9 is an isometric, exploded view of the example flashlight mounting system.

As shown in FIGS. 7 and 8 and as explained above, the slotted hole 52 in the light barrel 20 allows the connector 50, thus also the light activator plug 42, to move longitudinally forward and backward enough to turn the flashlight 22 on and off as described above. Turning now to FIG. 9 for a more complete view of the slotted hole 52, it can be seen that the slotted hole 52 can be provided with several different slotted portions. A first slotted portion 66 of the slotted hole 52 illustrated in FIG. 9 extends parallel to the longitudinal axis 44 of the light barrel 20 and is the portion 66 shown in FIGS. 7 and 8 which accommodates the movement of the light control sleeve 46, connector 50, and light activator plug 42 longitudinally back and forth to turn the flashlight on and off as explained above. A second portion 68 of the slotted hole 52 extends from the proximal end of the first portion 66 transverse to the longitudinal axis 44. To prevent the light control sleeve 46 from moving longitudinally to turn the flashlight 22 either on or off, the user can rotate the light control sleeve 46, thus also the connector 50 and the light activator plug 42, to move the connector 50 into the second, transverse, portion 68 of the slotted hole 52. In that rotated position, the connector 50, thus also the light activator plug 42, is prevented by the light barrel 20 from moving longitudinally forward, which prevents the light activator plug 42 from pushing the push-button on-off switch 40 to turn the flashlight 22 on or off. Further, if the connector 50 is a threaded cap bolt as illustrated in FIGS. 7-9 or something similar, it can be tightened to retain the connector 50 in that second portion 68 of the slotted hole 52 to prevent the flashlight 22 from being turned on or off accidentally or unintentionally.

As another option for an even more secure position that prevents the flashlight 22 from being turned on or off accidentally or unintentionally, an optional third slotted portion 70 of the slotted hole 52 can be provided to extend from the end of the second portion 68 that is opposite the first portion 66, parallel to the longitudinal axis 44 toward the distal end 34 of the flashlight mounting system 10 as shown in FIG. 9, but not far enough for the light control sleeve 46, connector 50, and light activator plug 42 to turn the flashlight 22 on or off. In other words, the third slotted portion 70 is shorter than the first slotted portion 66. Therefore, to inhibit the flashlight 22 from being turned on or off accidentally or unintendedly, the light control sleeve 46 can be rotated with the connector in the second slotted portion 68 of the slotted hole 52 until the connector 50 aligns with the third slotted portion 70 and then pushed forward to move the connector 50 into the third slotted portion 70 of the slotted hole 52. With the connector 50 positioned in that third slotted portion 70, the light control sleeve 46 cannot be pushed forward far enough to turn the flashlight 22 on or off, and it also cannot be rotated to get the connector back to the first slotted portion 66. Of course, if the user wants to again be able to turn the flashlight 22 on or off, the user can easily pull the light control sleeve 46 rearward to move the connector out of the third portion 70 and into the second slotted portion 68 of the slotted hole 52 and then rotating the light control sleeve 46 to move the connector 50 through the second slotted portion 68 back into the first slotted portion 66. In that position with the connector 50 again in the first slotted portion 66 of the slotted hole 50, the light control sleeve 46, connector 50, and light activator plug 42 can again be pushed forward to turn the flashlight on or off as explained above.

Figure 10:
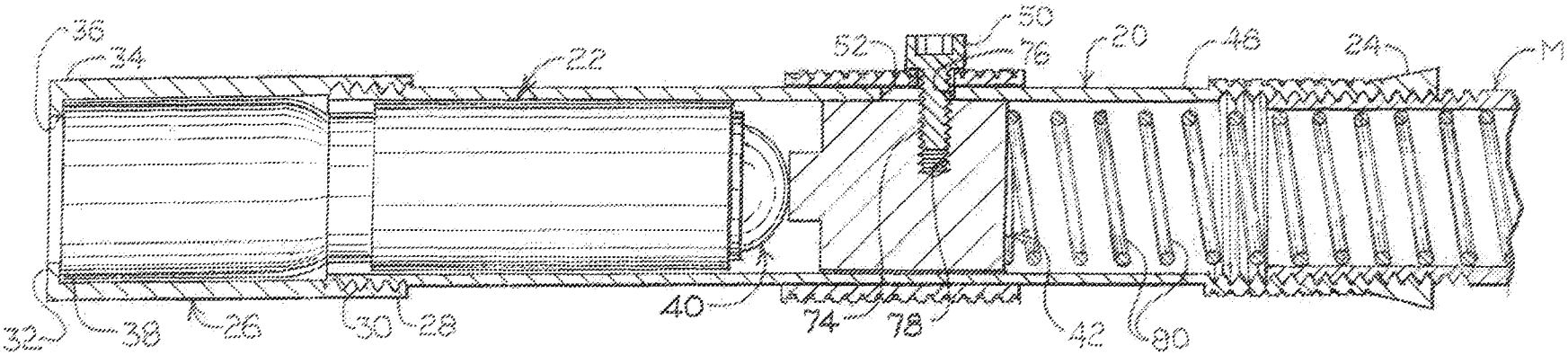
FIG. 10 is an enlarged cross-section view similar to FIG. 6 illustrating the example flashlight mounting system mounted on the distal end of a firearm magazine tube.

The example flashlight mounting system 10 is shown in FIG. 10 mounted on the distal end 14 of a shotgun magazine tube M. As mentioned above, many shotguns have a magazine cap (not shown) screwed onto the distal end 14 of the magazine tube, so, for those kinds of firearms, the light barrel 20 of the example flashlight mounting system 10 can be screwed onto the distal end 14 of the magazine tube M in place of the magazine cap (not shown). Also, many of such shotguns, e.g., many pump action shotguns and semi-automatic shotguns, have a magazine spring 80 in the magazine tube M to urge shotgun shells (not shown) in the magazine tube M rearwardly into the receiver R (FIG. 1), from where the shotgun shells are loaded into the breech end of the barrel B of the shotgun. It is typical for such magazine springs in the magazine tube M to bear against the inside of the magazine cap. When the example flashlight mounting system 10 is mounted on the distal end 14 of a magazine tube M of such a shotgun as shown in FIG. 10 in place of the magazine cap, the magazine spring 80 extends from the distal end 14 of the magazine tube M into the light barrel 20 of the flashlight mounting system 10, where the magazine spring 80 bears against the light activator plug 42. The spring force of the magazine spring 80 is not enough to push the flashlight on-off button 40, but it is sufficient to prevent the light activator plug 42 and the flashlight 22 from bouncing back and forth in the light barrel 20, even during recoil when the shotgun is fired. Consequently, when the example flashlight mounting system 10 is mounted on a firearm with the magazine spring 80 of the firearm extending into the light barrel 20 as shown in FIG. 10, it is may not be necessary to tighten the connector 50 to keep the light activator plug 42 and the flashlight 22 from moving back or forth in the light barrel 20 on their own, even when the connector 50 is in the longitudinal first slotted portion 66 or the third slotted portion 70 of the slotted hole 52. However, if the example flashlight mounting system 10 is mounted on a firearm that does not have a magazine spring to extend into the light barrel 20 to bear against the light activator plug 42, a substitute spring (not shown) can be positioned in the light barrel 20 to prevent the light activator plug 42 and the flashlight 22 from moving or bouncing back and forth in the light barrel 20 on their own.

Figure 11:
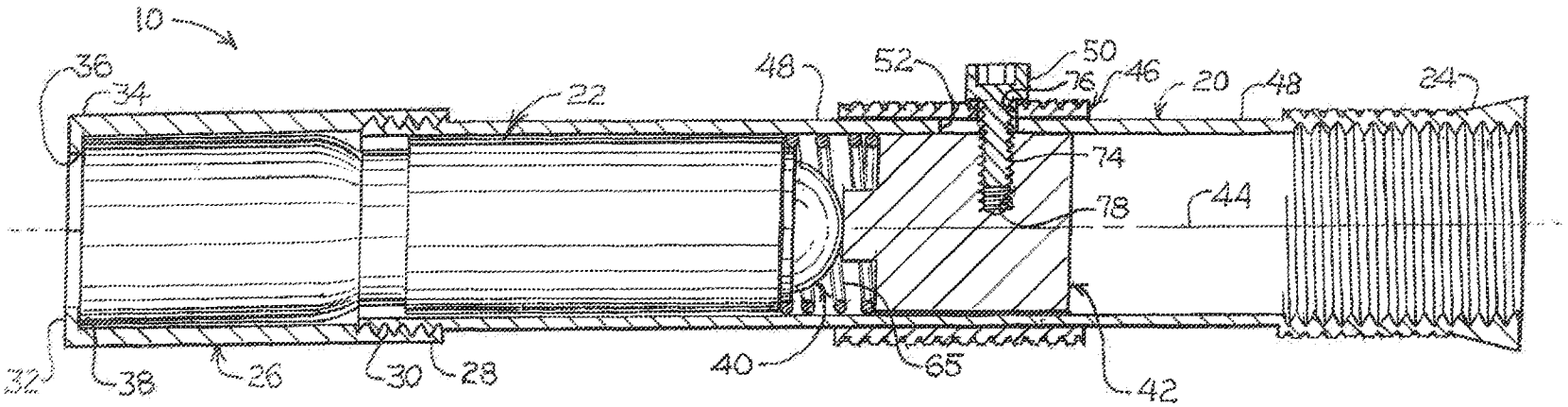
FIG. 11 is an enlarged cross-section view similar to FIG. 6 illustrating example flashlight mounting system with an optional spring between the light activator block and the flashlight.

Another option for a more secure retention of the connector 50 out of the first and second slotted portions 66, 68 may include an alternate third slotted portion 72 shown in FIG. 9 in broken lines, which extends in the opposite direction (rearward) from the second slotted portion 68. An optional spring 65 between the light activating plug 42 and the back end of the flashlight 22 as illustrated in FIG. 11 can be provided to urge the light activator plug 42 rearwardly and yieldably hold the connector 50 in that alternate third slotted portion 72 without the need for tightening or otherwise securing the connector 50 in that position. Therefore, to remove the light control sleeve 46, connector 50, and light activator plug 42 from that secure position in the alternate third slotted portion 72 of the slotted hole 52 to turn the flashlight 22 on or off, the user just has to move the light control sleeve 46 forwardly against the bias force of the optional spring 65 enough to move the connector 50 into the second slotted portion 68 of the slotted hole 52, then rotate the light control sleeve 46 to move the connector 50 into the first portion 66 of the slotted hole 52, and then push the light control sleeve 46 forward against the bias force of the optional spring 65 and the bias force of the push-button on-off switch 40. Such an optional spring 65 between the light activator plug 42 and the flashlight 22 can also be provided if desired or needed to push the light activator plug 42 away from the flashlight 22, for example, if the particular flashlight used does not have a resilient force biasing component 60 or if the resilient force biasing component 60 of a particular flashlight does not have enough bias force to push the light activator plug 42 away from the flashlight enough by itself to enable operation of the on-off button 40 of the particular flashlight.

While the connector 50 is illustrated diagrammatically in FIGS. 7 and 8 as a cap bolt with a threaded shank 74 that extends through a hole 76 in the light control sleeve 46 and screws into a threaded hole 78 in the light activator plug 42, the hole 76 in the light control sleeve 46 could be threaded instead of the hole 78 in the light activator plug 42. As another alternative, the connector 50 could be a bolt or pin that extends diametrically all the way through both the light control sleeve 46 and the light activator plug 42. Other types of connectors could also be used for fastening the light control sleeve 46 to the light activator plug 42 as would be apparent to a person skilled in the art once such person becomes familiar with and understands the example flashlight mounting system 10.

While the example flashlight mounting system 10 is shown with the retention sleeve 26 mounted on the distal end of the light barrel 20 to hold the flashlight 22 in the light barrel 20, the retention sleeve 26 could be eliminated. For example, the distal end of the light barrel 20 could have a lip for retaining flashlight 22 in the light barrel 20 instead of the lip 32 in the retention sleeve 26, thus eliminating the need for the retention sleeve 26. In that case, the flashlight 20 could be inserted into the light barrel 20 through the proximal end 24 of the light barrel 20 before the proximal end 24 is screwed onto the firearm magazine tube M.

The foregoing description provides examples that illustrate the principles of the invention, which is defined by the features that follow. Since numerous insignificant modifications and changes will readily occur to those skilled in the art once they understand the invention, it is not desired to limit the invention to the exact example constructions and processes shown and described above. Other kinds of shotguns and some other kinds of firearms have similar stock, receiver, barrel, and magazine components, so the example flashlight mounting system 10 can also be mounted on such other kinds of shotguns and other kinds of firearms. Also, while the example flashlight mounting system 10 is illustrated as mounted on the distal end of the magazine tube of a shotgun, it could be mounted on the distal end of a magazine or other component of other types of firearms as will be understood by persons skilled in the art once they become familiar with and understand the example flashlight mounting system 10 described above. Accordingly, resort may be made to all suitable combinations, subcombinations, modifications, and equivalents that fall within the scope of the invention as defined by the features. The words "comprise," "comprises," "comprising," "include," "including," and "includes" when used in this specification, including the claims, are intended to specify the presence of stated features, integers, components, or steps, but they do not preclude the presence or addition of one or more other features, integers, components, steps, or groups thereof.

Embodiments of the invention in which an exclusive property or privilege is claimed are defined as follows:

1. Flashlight mounting apparatus for mounting a conventional flashlight, which has a light producing element on its distal end and a push-button on-off switch on its proximal end, to a distal end of a component of a firearm, comprising:

an elongate, cylindrical light barrel of a size and shape that accommodates positioning the flashlight inside the light barrel, wherein the light barrel has a proximal end and a distal end and includes attachment means for attaching the proximal end of the light barrel to the distal end of the component of the firearm;

a light activator plug positioned in a longitudinally slidable manner inside the light barrel;

a light control member positioned in a longitudinally slidable manner on an outside surface of the light barrel; and a connector extending through a slotted hole in the light barrel and connecting the light control member to the light activator plug, wherein the slotted hole has a first longitudinally slotted portion that is long enough to accommodate longitudinal movement of the connector far enough to accommodate longitudinal movement of the light activator plug inside of the light barrel far enough toward the distal end of the light barrel to actuate the push-button on-off switch of the flashlight positioned inside the light barrel.

2. The flashlight mounting apparatus of claim 1, wherein the light control member is a ring positioned around the outside surface of the light barrel.

3. The flashlight mounting apparatus of claim 1, wherein the connector includes a bolt that extends through the light control member and through the slotted hole in the light barrel and into the light activator plug.

4. The flashlight mounting apparatus of claim 1, including a retention sleeve mounted in a removable manner on the distal end of the light barrel, said retention sleeve having a radially inwardly extending lip around an aperture of a size that accommodates propagation of light produced by the flashlight in the light barrel while the lip prevents longitudinal movement of the flashlight through the distal end of the light barrel.

5. The flashlight mounting apparatus of claim 1, wherein the slotted hole also includes a transversely slotted portion that accommodates rotational movement of the light control member, the connector, and the light activator plug about the longitudinal axis of the light barrel, whereby rotational movement of the connector into the transversely slotted portion of the slotted hole prevents longitudinal movement of the light control member and longitudinal movement of the activator plug.

6. The flashlight mounting apparatus of claim 5, wherein the slotted hole also includes a second longitudinally extending portion extending from the transversely slotted portion of the slotted hole, whereby longitudinal movement of the connector into the second longitudinally slotted portion of the slotted hole prevents rotational movement of the light control member and rotational movement of the light activator plug.

7. The flashlight mounting apparatus of claim 1, wherein the attachment means for attaching the proximal end of the light barrel to the distal end of the component of the firearm includes the proximal end of the light barrel being threaded for mating attachment with threads on the distal end of the component.

8. A method of mounting a flashlight, which has a push-button on-off switch on the rear end of the flashlight, on a firearm, comprising:

inserting the flashlight in an elongate, cylindrical light barrel that has a slotted hole with a longitudinally extending first slotted portion, a light activator plug positioned in a longitudinally slidable manner in the light barrel proximal to the rear end of the flashlight, and a light control member positioned in a longitudinally slidable manner on an outside surface of the light barrel, and a connector extending from the light control member through the slotted hole in the light barrel and into the light activator plug; and mounting the light barrel on a component of the firearm either before or after inserting the flashlight in the light barrel.

9. The method of claim 8, including mounting the light barrel on a distal end of a magazine component of the firearm.

* * * * *